US007338180B2

(12) United States Patent
Wing

(10) Patent No.: US 7,338,180 B2
(45) Date of Patent: Mar. 4, 2008

(54) LIGHTED SHELF ASSEMBLY FOR A REFRIGERATOR

(75) Inventor: Forrest F. Wing, Des Moines, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 124 days.

(21) Appl. No.: 11/312,406

(22) Filed: Dec. 21, 2005

(65) Prior Publication Data

US 2007/0139909 A1 Jun. 21, 2007

(51) Int. Cl.
*F21V 33/00* (2006.01)

(52) U.S. Cl. ..... 362/92; 362/133; 312/408; 62/264

(58) Field of Classification Search ..... 362/133, 362/92; 62/264; 312/408
See application file for complete search history.

(56) References Cited

U.S. PATENT DOCUMENTS

| | | | | |
|---|---|---|---|---|
| 3,506,325 | A | 4/1970 | Horvay | |
| 4,489,995 | A | 12/1984 | Barr | |
| 4,689,726 | A | 8/1987 | Kretzschmar | |
| 5,034,861 | A | 7/1991 | Sklenak et al. | |
| 5,287,252 | A | 2/1994 | Caruso | |
| 5,403,083 | A * | 4/1995 | Dasher et al. | 312/408 |
| 5,626,084 | A | 5/1997 | Kelly et al. | |
| 5,690,415 | A | 11/1997 | Krehl | |
| 5,758,585 | A | 6/1998 | Latchinian | |
| 6,042,244 | A | 3/2000 | Witkoski | |
| 6,065,821 | A | 5/2000 | Anderson et al. | |
| 6,210,013 | B1 | 4/2001 | Bousfield | |
| 6,231,205 | B1 | 5/2001 | Slesinger et al. | |
| 6,786,562 | B2 | 9/2004 | Obrick et al. | |
| 2003/0020387 | A1 * | 1/2003 | Wing et al. | 312/408 |

FOREIGN PATENT DOCUMENTS

| | | |
|---|---|---|
| GB | 2248676 | 4/1992 |
| GB | 2255820 | 11/1992 |
| GB | 2255820 A * | 11/1992 |

* cited by examiner

*Primary Examiner*—Jong-Suk (James) Lee
*Assistant Examiner*—Kevin Spinella
(74) *Attorney, Agent, or Firm*—Michael D. Lafrenz; Kirk Goodwin

(57) ABSTRACT

A refrigerator includes a vertically and/or laterally adjustable lighted shelf assembly. The shelf assembly is supported by a shelf support rail arranged in the refrigerator. First and second contact strips are mounted to the shelf support rail and electrically connected to a voltage source in the refrigerator. The shelf assembly includes a mounting member for attaching the shelf to the shelf support rail. The mounting member includes a first terminal strip and a second terminal strip. With this arrangement, when the shelf member is supported by the shelf support rail, the first and second terminal strips automatically engage with the first and second contact strips to complete an electrical circuit for powering the light unit. The electrical connection remains intact upon laterally shifting the shelf assembly on the shelf support rail.

8 Claims, 2 Drawing Sheets

LIGHTED SHELF ASSEMBLY FOR A REFRIGERATOR

BACKGROUND OF THE INVENTION

1. Field of the Invention

The present invention pertains to the art of refrigerators and, more particularly, to a lighted shelf assembly for a refrigerator.

2. Discussion of the Prior Art

Providing adequate lighting in a refrigerator compartment is a long recognized problem. Typically, a light is positioned in an upper portion of the refrigerator compartment and directed downward onto items supported upon refrigerator shelves. Unfortunately, as the number of items introduced into the refrigerator rises, it becomes increasingly difficult to illuminate those items. That is, items placed in an upper portion of the compartment block or prevent light from reaching lower portions of the refrigerator. Thus, while the top shelf is illuminated, items resting upon lower shelves are in the shadows. In order to address this problem, several manufacturers have mounted lighting to an underside of one or more shelves in the refrigerator.

In order to power the lighting, an electrical connection must be established between a voltage (typically a low voltage) source and the shelf. For a stationary shelf, a direct electrical connection between the electrical source and the lighting can be utilized. However, as most refrigerators include vertically adjustable shelves, some form of connector must be employed to join the lighting/shelf assembly with the voltage source at multiple vertical locations. More specifically, as vertically adjustable shelves can be removed, repositioned and remounted at different positions on a shelf support rail, a connector of some form must be incorporated into an interface between the shelf and the support rail to provide a pathway for electricity to reach the lighting. Actually, multiple connections must be employed so that the shelf is connected to the electrical source at every possible vertical position.

The prior art contains several examples of lighted refrigerator shelves that employ some form of connector. The connectors disclosed in the prior art generally include a first portion provided in a shelf support element and a second portion incorporated into the shelf support rail. With this arrangement, an electrical connection is established between the voltage source and the lighting regardless of the position of the shelf along the shelf support rail. That is, each time the shelf is moved to a different vertical position, the connector on the shelf support plugs into a connector on the shelf support rail to establish an electrical connection. While effective, providing a distinct electrical connection at each possible vertical height position increases the cost and complexity of the refrigerator. Moreover, the above-described electrical connections cannot accommodate lateral movement of the shelf.

Therefore, despite the presence of lighted, adjustable refrigerator shelves in the prior art, there still exists a need for an enhanced adjustable, lighted refrigerator shelf. More specifically, there exists a need for an adjustable lighted refrigerator shelf which requires a minimal number of electrical connection points while still enabling the shelf to be selectively vertically and/or laterally repositioned in the refrigerator.

SUMMARY OF THE INVENTION

The present invention is directed to a lighted shelf assembly for a refrigerator including a cabinet having arranged therein a liner with top, bottom, rear and opposing side walls that collectively define one of a fresh food compartment and a freezer compartment. A shelf support rail or bar extends laterally across the rear wall of the liner between the opposing side walls. In accordance with the invention, the shelf support rail includes a main body portion having a first end, a second end, an upper edge portion and a lower edge portion. First and second contact strips are mounted to the shelf support rail in order to establish a first portion of an electrical connection. The first and second contact strips are electrically connected to a voltage source, preferably a low voltage source, in the refrigerator.

A shelf assembly is supported on the shelf support rail. The shelf includes a support surface having front, rear and opposing side portions, at least one light unit and a mounting member for attaching the shelf assembly to the shelf support rail. While the shelf assembly could constitute a stationary unit, in accordance with one aspect of the invention, the mounting member supports the shelf so as to be laterally shiftable relative to the cabinet. Thus, in accordance with the most preferred form of the invention, the mounting member includes a hook portion having a first terminal strip and a base portion having a second terminal strip. The first and second terminal strips establish a second portion of the electrical connection. With this arrangement, when the shelf member is supported by the shelf support rail, the first and second terminal strips inter-engage with the first and second contact strips to establish an electrical circuit for powering the at least one light unit.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
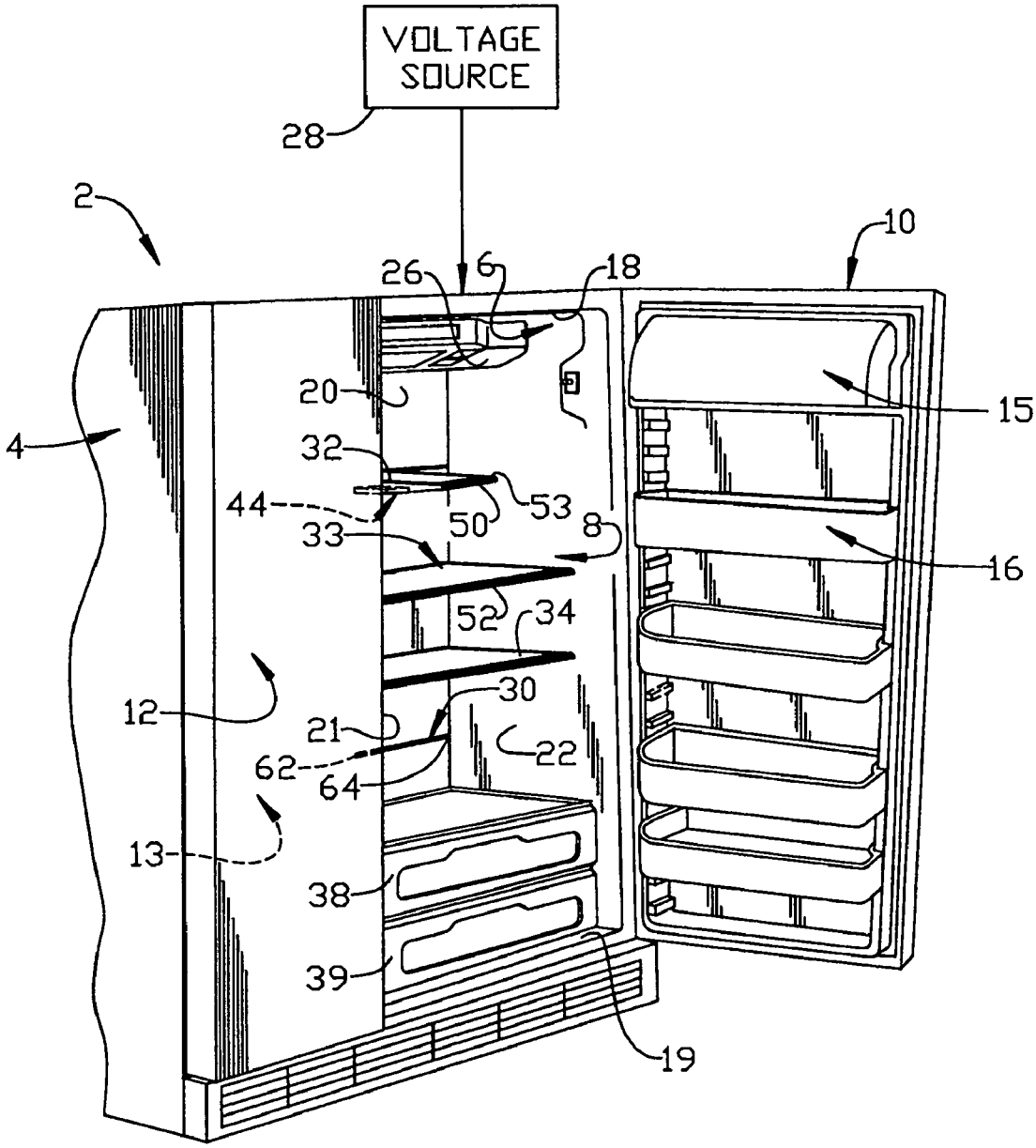
FIG. 1 is an upper left perspective view of a refrigerator incorporating a lighted shelf assembly constructed in accordance with the present invention.
Figure 2:
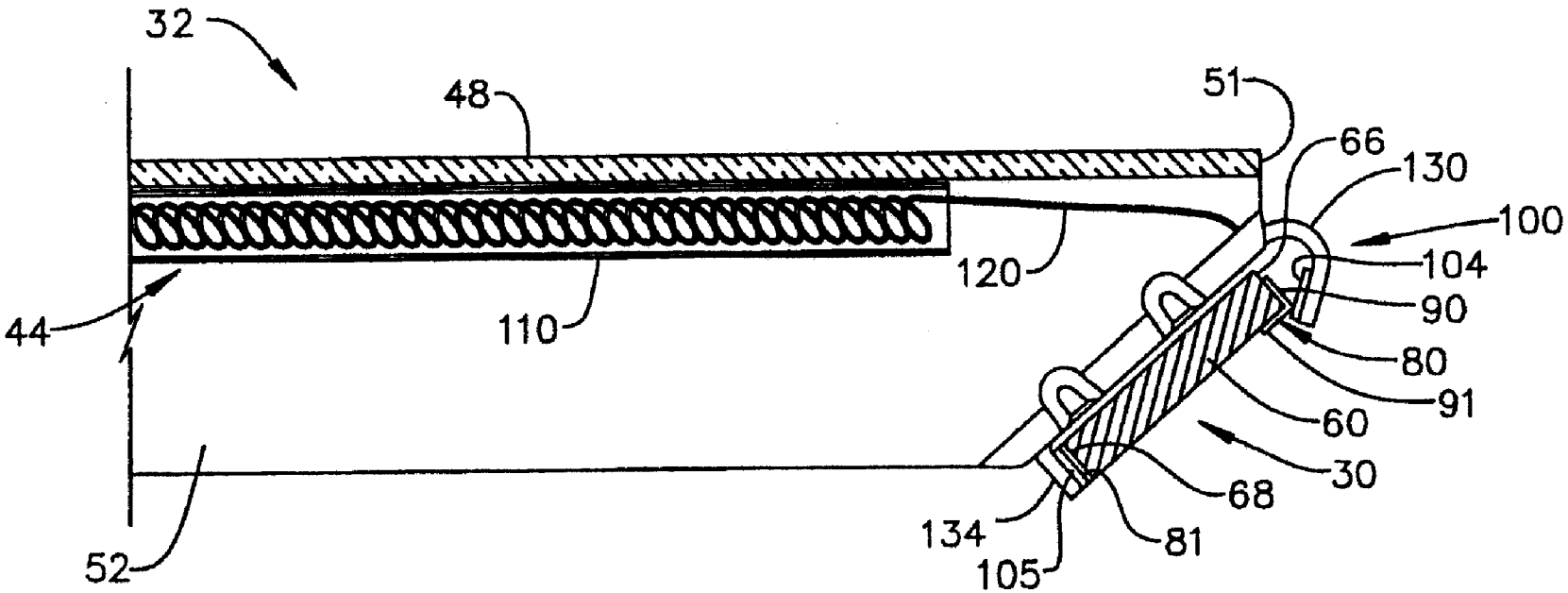
FIG. 2 is a partial, cross-sectional view of the lighted shelf assembly constructed in accordance with the present invention.

With reference to FIGS. 1 and 2, a refrigerator 2 includes an outer shell or cabinet 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a freezer compartment 13. For the sake of completeness, an inside portion of fresh food door 10 of refrigerator 2 is shown to include a dairy compartment 15 and various vertically adjustable shelving units, one of which is indicated at 16.

As shown, fresh food compartment 8 includes top, bottom, rear and opposing side walls 18-22. Mounted in an upper region of fresh food compartment 8 is a temperature control housing 26 which, in a manner known in the art, enables a consumer to selectively control temperature settings in fresh food compartment 8 and freezer compartment 13. In addition, temperature control housing 26 incorporates a voltage source 28, preferably a low-voltage source. Extending laterally across rear wall 20 of fresh food compartment 8 are a plurality of shelf support rails or bars, one of which is indicated at 30. As will be discussed more fully below, shelf support rails 30 constitute mounting structure for a plurality of vertically spaced shelf assemblies 32-34. Finally, a pair of bins 38 and 39 are shown at a lowermost portion of fresh food compartment 8.

To this point, the above-described structure is known in the art and presented only for the sake of completeness. The present invention is particularly directed to the incorporation of a light unit 44 to shelf assembly 32. Of course it should be understood that each shelf assembly 32-34 could include a respective light unit 44 that shines down or illuminates the respective one of shelf assemblies 33-34 positioned therebelow. In any event, shelf assembly 32 includes a top or supporting surface 48 as well as front, rear and opposing side portions 50-53. In the embodiment shown, shelf assembly 32 constitutes a half-width shelf that is laterally shiftable, i.e., shiftable in a substantially horizontal plane, in fresh food compartment 8.

In accordance with the invention, shelf support rail 30 includes a main body portion 60 having a first end 62, a second end 64, an upper edge portion 66 and a lower edge portion 68. As indicated above, shelf assembly 32 is supported on main body portion 60 and laterally shiftable between first and second ends 62 and 64. Therefore, shelf assembly 32 can be selectively positioned so that tall objects, such as soda bottles, can be supported by shelf 33 and project beyond support surface 48 at one side of shelf 33 thereby providing the consumer with additional storage options.

In further accordance with the invention, shelf support rail 30 includes a first connector portion which takes the form of first and second contact strips 80 and 81 that are directly, electrically coupled to voltage source 28. Preferably, first contact strip 80 extends along upper edge portion 66 of shelf support rail 30, while second contact strip 81 extends along lower edge portion 68. Actually, first contact strip 80 is preferably L-Shaped such that a first section 90 of contact strip 80 extends along upper edge portion 66, while a second portion 91 extends along a rear surface (not separately labeled) of shelf support rail 30 as clearly shown in FIG. 2. In any event, first and second contact strips 80 and 81 extend along an entire length of shelf support rail 30 between first and second ends 62 and 64 so as to enable shelf 32 to be laterally shiftable, yet still maintain an electrical connection for light unit 44 in a manner that will be detailed more fully below.

In still further accordance with the invention, shelf assembly 32 includes a mounting member 100. Mounting member 100 is designed to cooperate with shelf support rail 30 to locate shelf assembly 32 at a preferred position in fresh food compartment 8. In order to provide the electrical circuit necessary to power light unit 44, mounting member 100 includes a second connector portion which preferably takes the form of first and second terminal strips 104 and 105. When shelf 32 is supported upon shelf support rail 30, first and second terminal strips 104 and 105 respectively engage with first and second contact strips 80 and 81 to establish a closed electrical circuit to power light unit 44.

Light unit 44 preferably takes the form of a low-voltage light strip 110 coupled to a multi-conductor cable 120. While only a portion of light unit 44 is illustrated in FIG. 2, light strip 110 preferably extends about a peripheral portion of shelf 32 directly below support surface 48. That is, in the preferred form of the invention, light strip 110 extends along side portion 52, across front portion 50 and back along side portion 53 so as to provide sufficient lighting to illuminate, for example, shelf 33.

In accordance with the most preferred form of the invention, mounting member 100 includes a first or generally hook shaped portion 130 and a second or base portion 134. Preferably, first terminal strip 104 is secured along an inner surface (not separately labeled) of hook portion 130, while second terminal strip 105 is secured to an upper surface (not separately labeled) of base portion 134. With this arrangement, shelf assembly 32 can be cantilevered from shelf support rail 30 causing first and second contact strips 80 and 81 to mate with first and second terminal strips 104 and 105 respectively, thereby establishing and maintaining a secure electrical connection. Thus, not only can shelf assembly 32 be readily vertically repositioned in fresh food compartment 8 without requiring multiple connectors, but shelf assembly 32 can also be laterally shifted upon shelf support rail 30 without disrupting an already established connection. More specifically, given that first and second contact strips 80 and 81 extend an entire length of shelf support rail 30, shelf assembly 32 can be positioned at any point between first and second ends 62 and 64, with light unit 44 remaining continuously electrically coupled to voltage source 28.

Although described with reference to a preferred embodiment of the invention, it should be readily understood that various changes and/or modifications can be made to the invention without departing from the spirit thereof. For instance, while described as a low-voltage light strip, the light which could be constituted by any number of available light sources, such as fluorescent, halogen, LED, optical, etc. In addition, while shown mounted in a fresh food compartment of a refrigerator, the lighted shelf assembly could also be employed in a freezer compartment. Furthermore, while the low voltage source is described as being mounted in the temperature control housing, various other locations would be acceptable. In general, the invention is only intended to be limited by the scope of the following claims.

I claim:

1. A refrigerator comprising:

a cabinet;

a liner arranged within the cabinet, said liner including top, bottom, rear and opposing side walls that collectively define one of a fresh food compartment and a freezer compartment;

a low-voltage source;

one or more shelf support rails extending laterally across the rear wall of the liner between the opposing side walls, said one or more shelf support rails including a main body portion having a first end, a second end, an upper edge portion carrying a first contact strip and a lower edge portion carrying a second contact strip, said first and second contact strips extending along the main body portion between the first and second ends and are electrically connected to the low-voltage source; and a shelf for supporting objects in the refrigerator, said shelf including a support surface having front, rear and opposing side portions, at least one light unit and a mounting member, said mounting member supporting the shelf on one of the one or more shelf support rails in a manner enabling the shelf to be laterally shiftable relative to the liner, said mounting member including a hook portion having a first terminal strip for hooking on the upper edge portion and a base portion having a second terminal strip for engaging the lower edge portion, said first and second terminal strips being electrically connected to the at least one light unit wherein, when the shelf is supported by one of the shelf support rails with the hook portion hooked on the upper edge portion and the base portion engaging the lower edge portion, said first and second terminal strips respectively engage with the first and second contact strips completing an electrical circuit for powering the light unit.

2. A refrigerator comprising:

a cabinet;

a liner arranged within the cabinet, said liner including top, bottom, rear and opposing side walls that collectively define one of a fresh food compartment and a freezer compartment;

a voltage source;

one or more shelf support rails extending laterally across the rear wall of the liner between the opposing side walls, said shelf support rails including a main body portion having a first end, a second end, an upper edge portion canving a first contact strip and a lower edge portion carrying a second contact strip, said first and second contact strips being electrically connected to the voltage source; and at least one shelf for supporting objects in the refrigerator, said shelf including a support surface having front, rear and opposing side portions, at least one light unit and a mounting member, said mounting member supporting the shelf on one of the one or more shelf support rails said mounting member including a hook portion having a first terminal strip for hooking on the upper edge portion and a base portion having a second terminal strip for engaging the lower edge portion, said first and second terminal strips being electrically connected to the at least one light unit wherein, when the shelf is supported by one of the shelf support rails with the hook portion hooked on the upper edge portion and the base portion engaging the lower edge portion, said first and second terminal strips respectively engage with the first and second contact strips completing an electrical circuit for powering the light unit.

3. The refrigerator according to claim 2, wherein the first contact strip is secured to the upper edge portion of the shelf support rails and the second contact strip is secured to the lower edge portion of the shelf support rails.

4. The refrigerator according to claim 2, wherein the voltage source is constituted by a low-voltage source.

5. The refrigerator according to claim 2, wherein the first and second contact strips extend along the main body portion of the shelf support rails between the first and second ends.

6. The refrigerator according to claim 5, wherein the first contact strip is generally L-Shaped, having a first section secured to the upper edge portion of the shelf support rail and a second section secured to a rear portion of the shelf support rail.

7. The refrigerator according to claim 2, wherein the light unit is constituted by a light strip extending about a peripheral portion of the shelf.

8. The refrigerator according to claim 2, wherein the shelf is constituted by a laterally shiftable shelf, said laterally shiftable shelf being selectively positionable between the first and second ends of the shelf support rail while simultaneously maintaining the electrical circuit.

* * * * *